United States Patent [19]

Morton

[11] Patent Number: 4,642,650

[45] Date of Patent: Feb. 10, 1987

[54] PORTABLE HF ANTENNA

[76] Inventor: Thomas M. Morton, 4926 Odell St., St. Louis, Mo. 63139

[21] Appl. No.: 679,373

[22] Filed: Dec. 7, 1984

[51] Int. Cl.[4] ..... H01Q 1/10; H01Q 9/18

[52] U.S. Cl. ..... 343/745; 343/901

[58] Field of Search ..... 343/901, 903, 722, 745, 343/749, 750, 825, 830, 874, 875, 900, 883, 888–890, 820, 822, 823, 828, 860, 861, 891, 892, 915, 880–882

[56] References Cited

U.S. PATENT DOCUMENTS

| | | | |
|---|---|---|---|
| 2,118,429 | 5/1938 | Duttera | 343/875 |
| 2,642,754 | 6/1953 | De Conti | 343/890 |
| 3,474,453 | 10/1969 | Ireland | 343/750 |
| 3,541,558 | 11/1970 | Rhein | 343/901 |
| 4,222,053 | 9/1980 | Newcomb | 343/745 |
| 4,442,436 | 4/1984 | Newcomb | 343/750 |
| 4,459,597 | 7/1984 | Blaese | 343/900 |

*Primary Examiner*—Eli Lieberman
*Assistant Examiner*—Michael C. Wimer
*Attorney, Agent, or Firm*—Kalish & Gilster

[57] ABSTRACT

A fully collapsible, telescoping asymmetrically loaded half-wavelength vertical antenna. A base of the antenna formed of telescope sections, carries at its upper end an integral, coaxial LC matching network. Coaxially telescoped within the base is a mast formed of multiple telescoping sections, which may be extended and secured in sequence from the ground by an unassisted user. The matching network includes a coil wound concentrically about a form at the upper end of the base, the mast having a lower section telescoped within the coil by a controllable extent for providing preselected capacitance with the base. The upper end of the base serves as the feedpoint.

11 Claims, 10 Drawing Figures

PORTABLE HF ANTENNA

BACKGROUND AND SUMMARY OF THE INVENTION

This invention relates to low-frequency transmitting and receiving antennas, and more particularly, to a highly portable, easily erectable transmitting and receiving antenna for the high frequency bands.

There have been proposed and utilized many vertically polarized antennas for use in the high frequency (HF) bands, such as nominally 1.8 to 30 MHz. Perhaps the best known such antenna is the quarter-wave ground plane monopole wherein the radiating element is electrically substantially ¼ wavelength. Various multi-band variations of this antenna have been proposed, both with and without radial elements at the base of the antenna for establishing a ground plane, and utilizing one or more capacitive-inductive (LC) traps along the length of the radiating element to provide resonance at the desired center frequencies within the bands of interest thereby controlling the electrical length of the antenna for the different bands.

In another well-known multi-band antenna arrangement, the vertical element is one-half of the desired maximum wavelength, and is end-fed at the bottom of the element through an adjustable matching network, with traps provided along the length for causing the antenna to provide shorter effective lengths at higher frequencies within the bands of interest. In the design of such prior antennas, the capability of providing all-band operation within the frequency range desired involves, at best, a compromise in design. The use of LC traps along the length degrades efficiency and brings about the need, when changing frequency, for readjusting the matching network which, because of its typical complexity (which may include servomotors for inductive tuning from a remote location) is bulky and is not amenable to being integrated into the design of the antenna itself.

In any event, the use of bulky, cumbersome traps and extrinsic matching networks causes the resultant antenna to be anything but portable and anything but easily erected. Typically, such antennas of the prior art have therefore been intended for permanent or semi-permanent installation.

It is desirable to provide an HF antenna which is not only portable but which can be quickly and easily deployed and, thus, erected for immediate usage in a variety of areas of utilization, such as, for example, for military contingency communications, for emergency usage as by amateur radio and civil defense operators, for amateur radio portable operations, for short wave listening, and others who must have the capability for interim communications or do not have the facility for a permanent antenna.

Accordingly, among the several objects of the invention may be noted the provision of a highly portable transmitting and receiving antenna for the HF bands, as substantially from 1.8 to 30 MHz; the provision of such an antenna which is also quickly and easily deployed, and easily redeployed; which can be used in restricted spaces; which is utilizable for various modes of transmission, including AM, SSB and FM, and for radiotelephony, radiotelegraphy and facsimile, in any of a wide variety of usages, including emergency communications generally, for amateur radio, civil defense, military and contingency communications, as well as for portable and standby purposes generally; which is superlative for both receiving and transmitting throughout the entire HF frequency spectrum.

Among other objects of the invention may be noted the provision of such an antenna which when transmitting provides an excellent electrical impedence match at the desired frequency with a wide variety of transmitting equipment, including even solid state designs which are highly intolerant of electrical mismatch; which provides an extremely low voltage standing wave ratio (v.s.w.r.) for allowing the efficient transfer of transmitted energy to the antenna without substantial energy being reflected from the antenna along the transmission line to the transmitter; which functions well throughout the entire HF band; which obviates the need for the customary earth-ground connection; which functions electrically as a complete vertical half-wave radiator for providing an enhanced radiation pattern with gain typical of pure half-wave dipoles, such as typically at least 2.15 db over an isotropic radiator; which is asymmetrically fed at an advantageous location along its length; which includes an integral matching network of compact, easily-adjusted congifuration for radiation by the antenna within broad non-critical bands of interest within the HF spectrum, and which matching network also is coaxially configured with respect to the antenna for permitting the antenna elements and matching network to telescope; and which does not require that the matching network be readjusted when frequency is changed within a given band for which the matching network has been set, demonstrating wide band impedance matching.

Among still other objects by the invention may be noted the provision of such an antenna of which provides an extremely compact highly portable unit when collapsed; which when collapsed forms a completely self-contained package without requiring separate packaging provision for the various elements of the antenna; which can be quickly and easily as well as safely erected by a single person; which can be utilized in many different locations and orientations; which is easily manufactured, lightweight and easily shippable or transportable, such as by hand or as airline carry-on baggage, for example.

Other objects will be in part apparent and in part pointed out hereinbelow.

BRIEF DESCRIPTION OF THE DRAWINGS

Corresponding reference characters indicate corresponding parts throughout the views of the drawings.

DESCRIPTION OF THE PREFERRED EMBODIMENT

Figure 1:
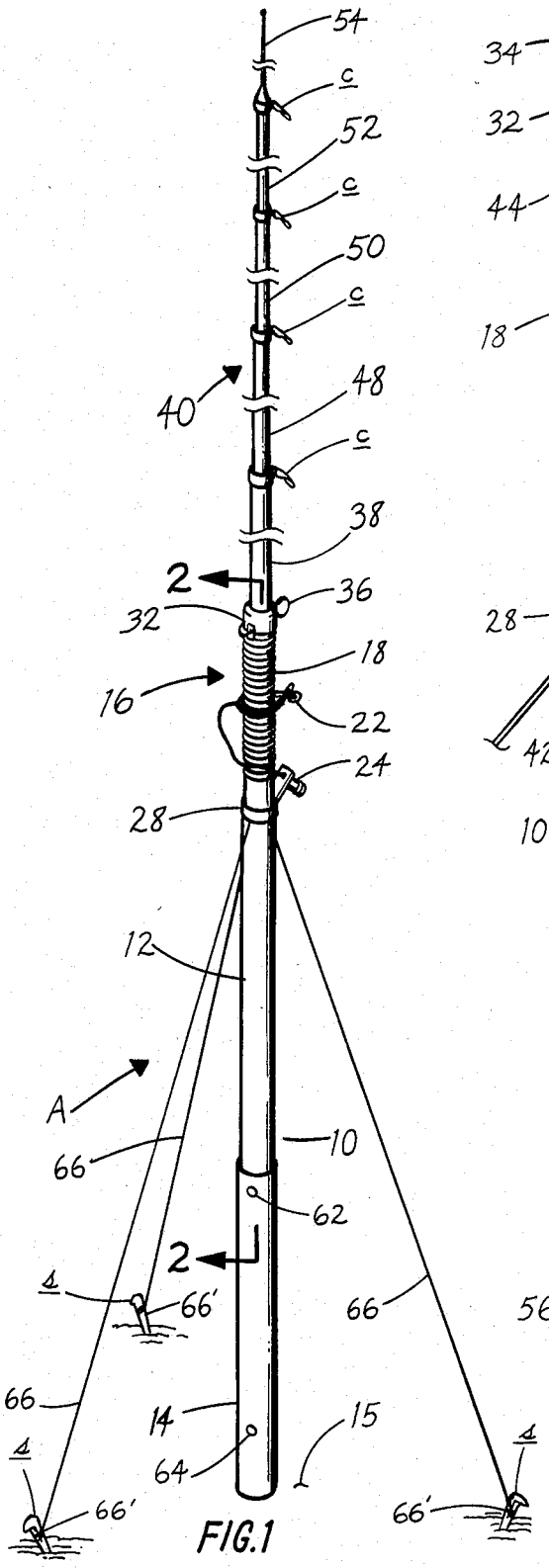
FIG. 1 is a perspective view, partly broken away, of a portable HF transmitting and receiving antenna in accordance with and embodying the present invention.
Figure 2:
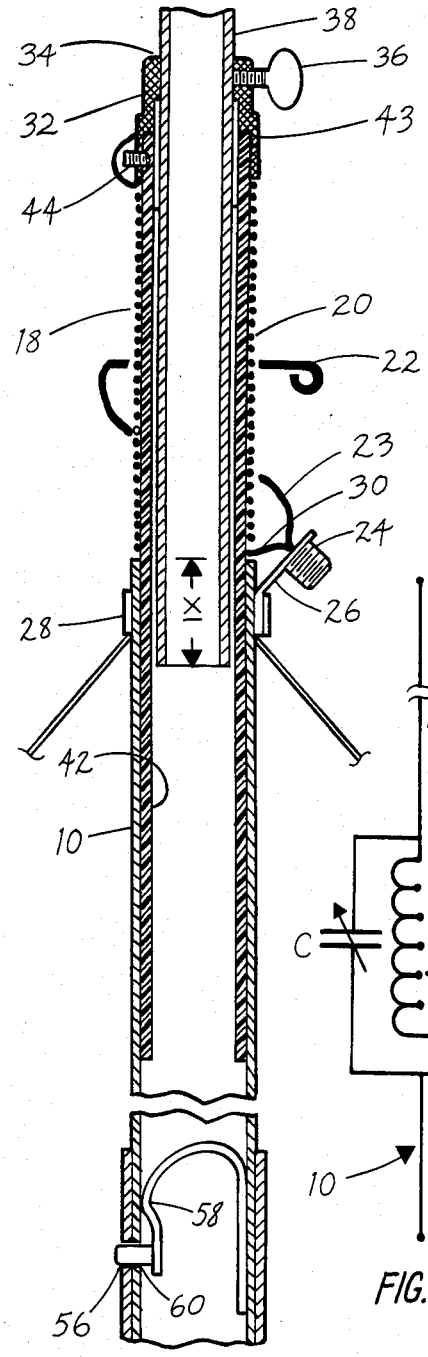
FIG. 2 is a fragmentary, enlarged vertical cross-section taken along line 2—2 of FIG. 1.

Referring to FIGS. 1 and 2, a preferred embodiment of the antenna is indicated generally at A. Briefly, antenna A is an asymmetrically loaded half wavelength vertical utilized without a ground plane. Accordingly, the antenna is dipolar. The antenna, which is of self-contained collapsible, telescoping configuration includes an integral, coaxial LC matching network carried at the upper end of a collapsible, telescoping base. The base includes stays or guys affixed to the base at point immediately below the matching network, by which the base may be guyed in preferably substantially vertical or near-vertical orientation. Alternatively, the base may be affixed to extrinsic structure. Coaxially telescoped within the base is a mast formed of multiple telescoping sections, which may be extended and secured in sequence from the ground by an unassisted user. The matching network comprises a coil wound concentrically about a form at the upper end of the base, the mast having a lower section telescoped within the coil by a controllable extent for providing preselected capacitance with the base.

More specifically, antenna A includes a base generally designated 10, formed of tubular base member 12 or so-called base tube having an extension 14 telescopingly received over its lower end. Extension 14 is also tubular, its lower end resting upon the surface 15 upon which the antenna is supported in substantially vertical orientation. However, as will soon be evident, the antenna can be oriented off the vertical axis. Carried at the upper end of base 10 is a matching network designated in its entirety at 16.

The matching network includes an inductor 18 in the form of a coil having evenly spaced turns 20, any one of which may be contacted as desired by a clamp-form tap 22 connected to a lead 23 for feeding from the antenna feed point, e.g., an SO-239 coaxial connector 24 for connection of a coaxial transmission line. Connector 24 is carried by a conductive bracket 26 extending from a support clamp 28 of annular configuration so that the braid or shield side of connector 24 is electrically connected to base 10. The connector arrangement shown is merely one of different possible feedpoint configurations, and connector 24 may be molded or otherwise faired into the construction. The center terminal of connector 24 is connected also by a lead 30 to the lower end of coil 18.

The upper end of the coil is connected to a clamp head or ferrule 32 including a main collar portion 34 having a hand-tightenable clamp screw 36 for tightening of collar 34 about the periphery of a first section 38 of a mast of tubular configuration, as designated in its entirety generally at 40. Fitted within the upper end of base 10 is a tubular coil form 42 of dielectric material such as of polymethylmethacrylate, phenolic, acrilobutadiene-styrene, polystyrene or other suitable synthetic resin materials. Coil form 42 extends above the upper end of base member 10, its upper end carrying clamp head 32. For this purpose, a cylindrical sleeve 43 of clamp head 32 receives the upper end of coil form 42, being secured by a set screw 44. The upper end of coil 18 is electrically connected by clamp head 32 to the bottom mast section 38. As will be apparent in FIG. 2, the latter extends coaxially down within coil form 42 into base member 10. Accordingly, such lower portion of the bottom mast section 38 located within base member 12 provides a capacitive relationship with base member 12, the effective capacitance being dependent upon length x. Such capacitance with the inductance provided by coil 18, as determined by the position of tap 22, constitutes the LC matching network 16, which is thus seen to be entirely coaxial character and completely integral to the antenna.

Mast 40 is constituted by coaxially telescoped tubular sections 38, 48, 50, 52, and 54 such as each formed a successively smaller diameter aluminum tubing. Carried at the upper end of each of such sections are clamps c of the conventional toggle or lever type allowing the user to manually tighten same for clampingly engaging the section received within the respective clamp. When the clamps are loosened, all of the sections 48, 50, 52, 54 may be received within the bottom mast base section 38 which in turn can be fully received within the base tube 10 upon loosening of clamp screw 36.

Base member 12 includes at its lower end a locking button 56 carried by a leaf spring 58 fitted within the bore of the base member and urging button 56 through an aperture 60 in the lower end of the base member. Button 56 is received in an upper aperture 62 of base tube extension 12 for locking extension 14 in an extended position relative to base member 12, as shown in FIG. 1. Button 56 is depressed for permitting extension 14 to be telescopingly received over base member 12, being then received in a lower aperture 64 for locking base extension 12 in a collapsed orientation for storage, handling and carrying of the antenna.

Secured to collar 28 are at least three support lines or guys 66 which most preferably, but not necessarily, are of conductive wire such as twisted cable and having at their lower ends loops 66' for receiving stakes s for driving into surface 15 or being otherwise secured in spaced, preferably equilateral relationship around base 10 for support of the antenna with mast 40 in its extended, erected condition. However, the antenna does not require that the stays 66 be grounded, and their grounding is not preferred. Further, the stays are not utilized for certain modes of use of the antenna, as explained below.

Figure 3:
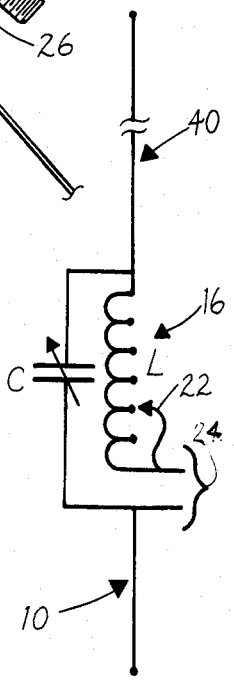
FIG. 3 is a schematic electrical representation of the new antenna.

Electrically, the antenna provides the circuit relationship shown in FIG. 3. Coil 16 provides an inductance of value L of value dependent upon the position of tap 22, and the extent x by which mast bottom section 38 extends into base member 12 provides a capacitance of value C. Inductance L effectively loads the bottom of mast 40 which capacitance C couples the bottom of mast 40 to base 10.

In accordance with the preferred construction, it is desired that the electrical equivalent length of antenna A from the bottom of base 10 to the tip of mast 40, with all sections of mast 40 extended and base extension 14 in the positions of FIG. 1 be substantially $\lambda/2$ where $\lambda$ is the wavelength at frequency f, the lowest intended frequency of the intended overall spectrum within which antenna A will be utilized, the feedpoint being approximately 0.2H from the bottom of base 10, where H is the physical length (or height) of the antenna, and keeping in mind that the physical length H of the antenna is substantially less than $\lambda/2$ at f as a result of matching network 16.

For providing antenna A with utility broadly within the HF band of 1.8 to 30 MHz, the antenna will be sized accordingly.

However, since the actual length of the half-wavelength antenna is dependent upon the diameter of the new antenna, the free space wavelength may be corrected by multiplying by a factor which is dependent upon the ratio of the free space measurement $\lambda/2$ to diameter of the antenna which, as will be evident, varies along the length of the antenna. But for such a ratio of 100, for example, the multiplication factor is approximately 0.96. On the other hand, the design of the new antenna is such as to avoid criticality as to length, since matching network 16 provides a wide range of operating frequencies.

As utilized to provide operation broadly within the amateur radio HF bands, antenna A may have the following dimensions generally: the overall length H is preferably 7.32–7.92 me., the length of mast 40 being preferably from about 5.5 to about 6.1 me., the length of base section 10 is preferably about 1.53 me., the length of coil 18 being preferably 30.5 cm. Such an antenna provides operation in the following amateur bands:

At frequencies below about 14 MHz, antenna tuner 16 is adjusted for each band of frequencies to be utilized, as necessary to provide a close match between the transmitter and the antenna, it being found that any given adjustment provides operation over a substantial range of frequencies, such as 100–200 Khz or more without readjustment. For frequencies above about 14 MHz, the new antenna is utilized without further readjustment of antenna tuner 16 being necessarily required and, at which higher frequencies, the additional length available within the antenna is such as to provide equivalent length up to $3\lambda/2$. Thus, whether operating in the mode of an equivalent length of $\lambda/2$ or $3\lambda/2$, the new antenna functions as a complete radiator, being thus entirely advantageous over a quarter-wave ground plane monopole.

The new antenna functions equally well for both transmitting and receiving. Although the reciprocity theorem dictates that an antenna will exhibit the same impedence and pattern characteristics for receiving as well as transmitting, it is well known that there are differences as concerns other properties for receiving antennas and transmitting antennas, one salient characteristic which is different for receiving being the antenna current distribution. Furthermore, the direction pattern of an antenna is such that an optimum pattern for transmitting may not be optimum for receiving. However, the present antenna provides no criticality in this respect, yielding a substantially vertical polarization pattern without substantial skewing resulting from the lack of a balun (the use of which is not mandated by the present antenna) or by asymmetric feeding.

Figure 4:
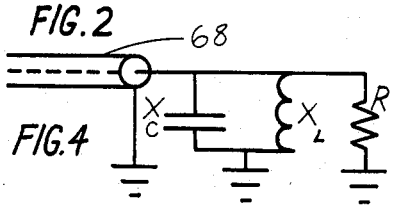
FIG. 4 is a schematic diagram representing an equivalent circuit of the new antenna.

An important advantage of the new antenna relates to its capability of providing an extremely close impedence match to the transmitter and transmission line. Referring to FIG. 4, an equivalent circuit is shown which represents the new antenna as coupled to a transmission line 68, the antenna being represented by a capacitive reactance $X_C$ in parallel with an inductive reactance $X_L$ and a radiaton resistance R. The new antenna exhibits such excellent impedence matching that transmission line 68 may be directly connected to a solid state transmitter or tranceiver without need for a separate antenna tuner or "transmatch", thus being extremely advantageous in permitting its direct connection to transmitting and receiving equipment as in field, emergency or portable usages where it is burdensome or impossible to provide an auxiliary matching network, antenna tuner or the like.

Figures 5, 6, 7, 8:
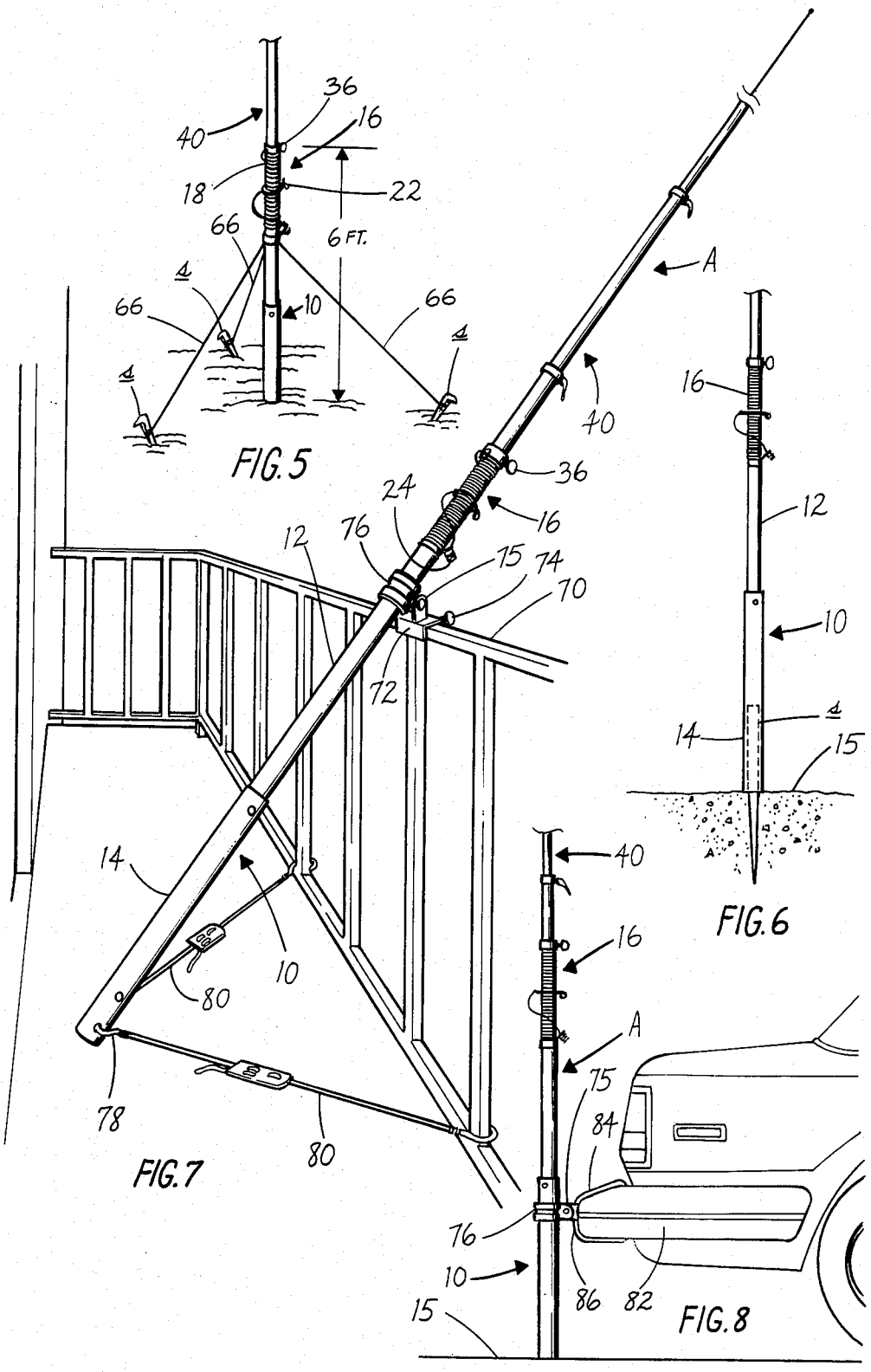
FIG. 5 is a fragmentary perspective view illustrating one manner of ground securement of the new antenna.
FIG. 6 is an elevation of base portions of the new antenna, showing yet another of several possible methods of ground securement of the antenna.
FIG. 7 is a perspective view, partly broken away, showing mounting of the new antenna by means of a balcony-type railing.
FIG. 8 is a fragmentary elevation of the antenna, showing its mounting to an automobile for stationary, portable use.

Referring to FIG. 5, positioning of mast 10 on the ground surface 13 causes the upper end of coil 18 to be presented approximately six feet above ground level. This permits the user to easily reach mast clamp 36 for adjustment and permitting mast erection by sequential extension of the mast sections and ultimately tightening of clamp screw 36 in a desired position for achieving an approximate capacitance for matching at the desired frequency. Tap 22 is then also easily adjusted to provide a position for giving desired inductive matching. Mast lower section 38 and coil form 42 may be marked with positioning idicia for pretuning operation within desired bands. The use of stakes s is merely representative, and guys 66 may just as readily be secured by attachment to dead weights such as sand bags, weighted milk containers, or the like.

FIG. 6 illustrates the use of a spike or single stake s driven into the ground 15 vertically, base section 14 being simply fitted over stake s and whereby the antenna will remain stably supported without the use of guys or stays.

FIG. 7 demonstrates yet another possible mounting arrangement, the new antenna being shown secured to balcony or porch railing 70 such as typical as those found in high rise buildings, apartments, condominiums and the like. A rail clamp 72 having a tightening screw 74 is fitted to the balcony rail and clamped in place. It has a suitable bracket pivotally secured, as at 75, to a collar 76 fitted around upper mast section 12. The base extension 14 is shown provided with suitable apertures or securement fixtures at its lower end, for receiving hooks, as at 78, which are carried at the outer end of a pair of line cinches 80 of adjustable length for thereby drawing base 10 tightly against the railing structure with the axis of the antenna, with the mast 40 extending outwardly from the balcony away from the building structure. In the orientation provided accordingly, matching network 16 and clamp screws 36 are easily reached by the user for adjusting the length of mast 40 and achieving matching characteristics by use of network 16, while readily permitting connection of transmission line to connector 24. The off-vertical orientation of antenna A is not deleterious and permits the full half-wavelength of the antenna to be realized.

Other securement options are also made available by the new antenna design. Thus, in FIG. 8, antenna A is secured to the bumper 82 of an automobile, as representative of any variety of vehicles. A clamp 84 of suitable configuration is affixed to bumper 82 and includes a bracket 86 for pivotal securement as at 75, to collar 76 which is positioned approximately along base 10 so that the lower end of the base is supported upon a ground surface 15, the antenna orientation being substantially vertical.

Figure 9:
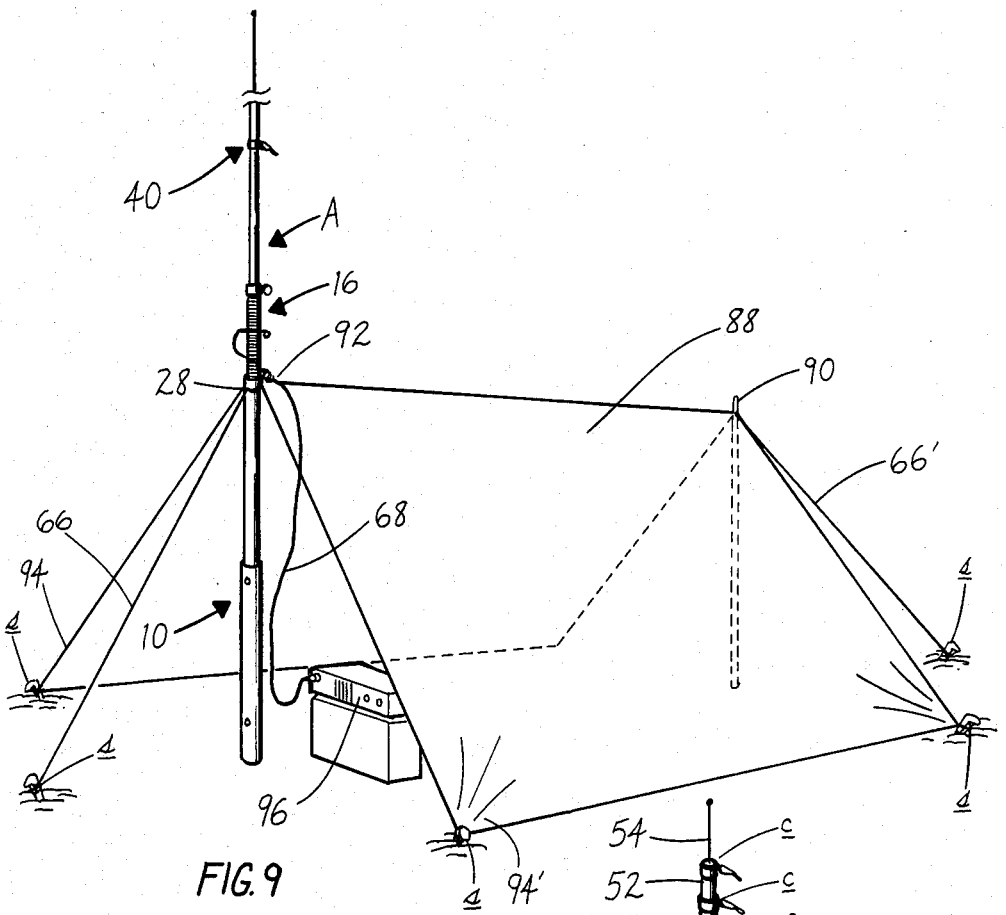
FIG. 9 is a perspective view, partly broken away, showing ground mounting and securement of the antenna in association with a shelter.

FIG. 9 demonstrates installation of antenna A in connection with a shelter 88 of tent configuration. Shelter 88 is supported over one of the antenna guys 66' which is extended over a tent pole 90 and staked to the ground by a stake s. One upper end 92 of the shelter is affixed to ring 28 or otherwise secured around the antenna below matching network 16 and whereby the shelter corners 94, 94' when staked as shown by stakes s provide, together with only one additional guy 66, completely stable support of antenna A. This permits use of a short transmission line 68 for connection to a transceiver 96 or other piece of radio gear to be connected to antenna A and thereby allowing shelter 88 to be the sheltered location for the operator while conveniently serving also to support antenna A.

Figure 10:
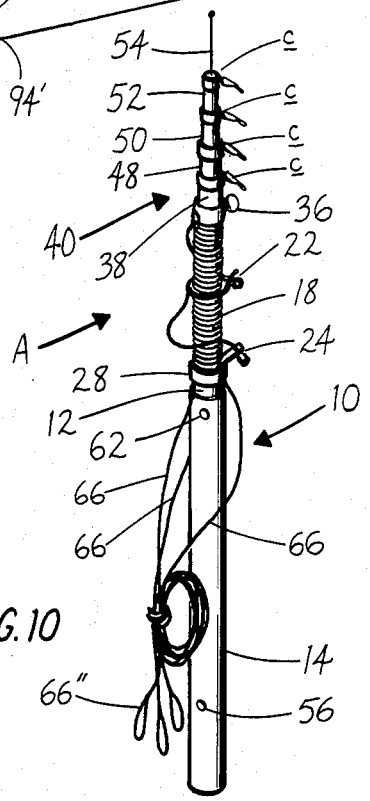
FIG. 10 is a perspective view showing the new antenna in a completely collapsed, compact, portable state.

FIG. 10 illustrates the new antenna A in completely collapsed configuration, its mast 40 being telescoped within base 10 which is itself shortened by telescoping base extension 14 over base tube 12. The guys or stays 66 may be coiled and the entire package received within a small container, such as those utilized, for example, for carrying fishing rods and the like, the entire length of the collapsed antenna being less than 1.5 me., yet wholly self-contained and immediately erectable for portable or emergency deployment or other usage desired without resort to tools, addition of matching networks, addition of support structures, stabilizers, extrinsic bracketry, guying and so forth.

It is preferred to construct the telescoping sections 12, 14 of base 10, as well as the telescoping sections of mast or whip 40, of lightweight aluminum alloy whereby there will be strength coupled with lightness for both extended and collapsed configurations of the antenna. Furthermore, the construction is advantageous since the dielectric coil form 42 extends well into the bore at the upper end of base section 10 and thus serves to provide dielectric spacing between the lower mast section 38 and the surrounding upper wall portion of base section 12. But as will also be apparent, coil form 42 thus provides a structural extension of the base 10 and by which mast 40 is supported. Accordingly, matching network 16 constitutes a structural part of the antenna, being structurally interposed between the base and mast in mast-carrying capacity, so that the matching serves both electrically matching and load-carrying functions.

In view of the foregoing, it will be seen that the several objects of the invention and other advantages are achieved by the new constructions which have been described.

Although the foregoing includes the description of the best mode of the embodiments contemplated for carrying out the invention, various modifications are contemplated.

As various modifications could be made in the constructions herein described and illustrated without departing from the scope of the invention, it is intended that all matter contained in the foregoing description or shown in the accompanying drawing shall be interpreted as illustrative rather than limiting.

What is claimed is:

1. A vertical-type asymmetrically loaded dipolar transmitting and receiving antenna of portable, easily deployed, telescopingly collapsible character usable over a wide range of operating frequencies, comprising:

a tubular base for forming one electrical end of the antenna;

a mast telescopingly received by the base for forming the opposite electrical end of the antenna, the mast being formed of multiple tubular sections each of progressively smaller diameter in the direction away from the base for each being extended and secured in sequence for mast erection, each mast section being electrically conductive for operation over the entire range of operating frequencies;

the base presenting at its upper end a coil form carrying an inductive coil constituted by conductor turns wound serially about the coil form;

clamp means carried at the upper end of the coil form for receiving a portion of the length of a lowermost section of the mast and for clampingly engaging such mast section portion for maintaining the mast in erected condition, the claim means being electrically conductive and connected to an upper end of the coil for thereby connecting the upper end of the coil to the lowermost mast section, the clamp means permitting user adjustment of the length portion of the lowermost mast section received by the clamp means, at least part of said length portion being telescopingly received by the upper end of the base for providing a capacitance of preselected value between the lowermost mast section and the upper end of the base;

feedpoint means carried at an upper end of the base including first terminal means electrically interconnected with the upper end of the base for providing a first feedpoint connection to the upper end of the base and second terminal means including a top connected to a selected turn of the coil along its length for providing a user-adjustable second feedpoint connection to the selected turn, and whereby the coil imposes an inductance of preselected value, determined by the selected turn, between the second terminal means and the lowermost mast section;

the coil form being constituted by a dielectric sleeve of tubular configuration having a lower portion telescopingly received by the upper end of the base for providing dielectric isolation between said portion of the mast section length and the upper end of the base, the coil form having an upper portion extending above the upper end of the base for carrying the turns of the coil; and means for mounting the base in upstanding orientation;

whereby the inductance and capacitance together provide a user-adjustable matching network for electrically matching the dipolar antenna to the feedline over said range of operating frequencies.

2. An antenna as set forth in claim 1, wherein said base is constituted by a tubular first section providing an upper end of said base, and a tubular second section for extending the first section downwardly therefrom and telescopingly receiving the first section, and means for interengaging the first and second sections for extending of the base and permitting the first section substantially to be received by the second section for collapse of said antenna.

3. An antenna as set forth in claim 2, wherein said means for interengaging the first and second sections of the base comprise a locking button carried by a leaf spring fitted within a bore of the first section, means for providing an aperture in the lower end of the first section through which said button is urged, and means for providing a further aperture at the upper end of said second section for receiving the button for locking the first and second sections in extended condition.

4. An antenna as set forth in claim 1, wherein the overall length of the antenna is H, the feedpoint means being located approximately 0.2H from the lower end of the base, whereby the antenna may be extended, and the matching network user adjusted, by a person standing at ground level.

5. An antenna as set forth in claim 1 further characterized by the means for mounting the base in upstanding orientation comprising a plurality of guys affixed to the base proximate the feedpoint means.

6. An antenna as set forth in claim 1 further characterized by the means for mounting the base in upstanding orientation comprising a collar affixed to the base and a support bracket means affixed to the collar for securement of the collar to extrinsic structure.

7. An antenna as set forth in claim 6 further characterized by support bracket means being configured for clamping to a balcony railing or the like, and further comprising means affixed to the upper end of the base for drawing the base against the balcony railing for causing the antenna to extend upwardly and outwardly from the balcony railing in extended configuration.

8. An antenna as set forth in claim 1 further characterized by the means for mounting the base comprising an upstanding structure extending above ground for being received by a bore defined by the base.

9. An antenna as set forth in claim 1 further characterized by the antenna being dimensioned when extended for being electrically equivalent to a one-half wavelength of the lowest intended operating frequency.

10. An antenna as set forth in claim 9 further characterized by the range of operating frequencies being from about 1.8 to about 30 MHz.

11. A vertical-type asymmetrically loaded dipolar transmitting and receiving antenna of portable, easily deployed, telescopingly collapsible character usable over a wide range of operating frequencies, comprising:

a tubular base for forming one electrical end of the antenna, the base being formed of multiple tubular sections each of progressively larger diameter in the downward direction for being extended in sequence for base erection, each base section being electrically conductive for operation over the entire range of operating frequencies;

a mast telescopingly received by the base for forming the opposite electrical end of the antenna, the mast being formed of multiple tubular sections each of progressively smaller diameter in the upward direction for being extended in sequence for mast erection, each mast section being electrically conductive for operation over the entire range of operating frequencies;

means carried by individual mast and base sections for securing corresponding mast and base sections in extended condition;

the base presenting at its upper end a coil form carrying an inductive coil constituted by conductor turns wound serially about the coil form;

clamp means carried by the base for receiving a portion of the length of a lowermost section of the mast and for clampingly engaging such mast section portion for maintaining the mast in erected condition, the clamp means being electrically conductive and connected to an upper end of the coil for thereby connecting the upper end of the coil to the lowermost mast section, the clamp means including user-operable means for permitting user adjustment of the length portion of the lowermost mast section received by the clamp means, at least part of said length portion being telescopingly received by the upper end of the base for providing a capacitance of preselected value between the lowermost mast section and the upper end of the base;

feedpoint means carried at an upper end of the base including first terminal means electrically interconnected with the upper end of the base for providing a first feedpoint connection to the upper end of the base and second terminal means including a tap connected to a selected turn of the coil along its length for providing a user-adjustable second feedpoint connection to the selected turn, and whereby the coil imposes an inductance of preselected value, determined by the selected turn, between the second terminal means and the lowermost mast section;

the coil form being constituted by a dielectric sleeve of tubular configuration having a lower portion telescopingly received by the upper end of the base for providing dielectric isolation between said portion of the mast section length and the upper end of the base, the coil form having an upper portion extending above the upper end of the base for carrying the turns of the coil; and means provided for at least one of said base sections carried for mounting the base in upstanding orientation;

whereby the inductance and capacitance together provide a user-adjustable matching network for electrically matching the dipolar antenna to a feedline over said range of operating frequencies.

* * * * *